United States Patent [19]

Smith

[11] Patent Number: 4,763,109

[45] Date of Patent: Aug. 9, 1988

[54] ACOUSTICAL VEHICLE HORN WITH IMPROVED VENT

[76] Inventor: Robert E. Smith, R.R. 1, Box 93, Rinard, Ill. 62878

[21] Appl. No.: 815,547

[22] Filed: Jan. 2, 1986

[51] Int. Cl.[4] ..... G08B 3/10

[52] U.S. Cl. ..... 340/388; 116/142 R; 340/384 E; 340/384 R; 340/404

[58] Field of Search ..... 340/384 R, 384 E, 386, 340/388, 401, 402, 404; 116/137 R, 138, 142 R, 142 FP, 142 FV; 179/115.5 ES, 115.5 H, 115.5 R; 181/152, 159; 408/701

[56] References Cited

U.S. PATENT DOCUMENTS

| | | | |
|---|---|---|---|
| 2,066,001 | 12/1936 | Gillet | 116/138 |
| 2,811,129 | 10/1957 | Buell | 116/142 R |
| 3,179,932 | 4/1965 | Gregoroff | 340/401 |
| 3,696,504 | 10/1972 | Cupler, II | 408/701 |
| 4,102,297 | 7/1978 | Reilly | 116/142 FP |
| 4,116,158 | 9/1978 | Wrnod | 340/388 |
| 4,149,153 | 4/1979 | Shigemori et al. | 340/388 |
| 4,267,552 | 5/1981 | Frigo | 340/388 |
| 4,310,065 | 1/1982 | Kayman | 181/159 |
| 4,433,750 | 2/1984 | Neese | 181/159 |
| 4,441,099 | 4/1984 | Neese | 340/388 |

*Primary Examiner*—Joseph A. Orsino, Jr.
*Assistant Examiner*—Brent A. Swarthout

[57] ABSTRACT

The motor chamber of an automotive vehicle horn is vented to the atmosphere through a hole in the diaphragm. The hole is located on a vibratory portion of the diaphragm and is laser drilled to obtain an accurately dimensioned hole with smooth edges.

3 Claims, 1 Drawing Sheet

ACOUSTICAL VEHICLE HORN WITH IMPROVED VENT

FIELD OF THE INVENTION

This invention relates to acoustical vehicle horns and more particularly it relates to an improved vent for the motor chamber of the horn.

BACKGROUND OF THE INVENTION

Automotive vehicle horns of the acoustic type comprise, in general, a linear electromagnetic motor mechanically coupled with a sound generating diaphragm which is acoustically coupled with the air column of a sound projector, typically of the convaluted or sea shell type. The motor is mounted within a housing and the circular diaphragm is mounted on the housing with its periphery in sealing engagement therewith to provide a chamber containing the motor. A projector is also mounted on the housing and the inlet and thereof is typically seated against the periphery of the diaphragm and is in sealing engagement therewith. The electromagnetic motor is adapted to be energized from the vehicle battery and includes switching contacts. When the motor is connected with the battery, as by closing a horn switch, the switch contacts are opened and closed by motion of the plunger which vibrates the diaphragm to generate sound energy.

It is well known that the motor chamber of this type of horn must be vented to the atmosphere in order to prevent overheating of the motor, especially when the motor is operated over relatively long periods. The overheating results from the heat dissipated by the motor itself within the chamber and also from the pumping action of the air contained within the chamber. In order to prevent such overheating, it is common practice to provide a vent passage between the motor chamber and the atmosphere.

Heretofore, the known venting arrangements have not been entirely reliable and have been relatively costly to incorporate in the horn structure.

In the Frigo U.S. Pat. No. 4,267,552 granted May 12, 1981, the motor chamber is vented by shaping the edge of the diaphragm so that it is provided with mutually orthogonal straight edges closely approaching the inner diameter of the flange of the housing thus providing a vent opening at each straight edge. In an alternative embodiment, the mounting flange of the housing which is crimped against the diaphragm is provided with diaphragm confronting channels which provide a vent path around the edge of the diaphragm.

In the vehicle horn of the Warnod U.S. Pat. No. 4,116,158 granted Sept. 26, 1978, the venting arrangement is provided at the peripheral mounting flange of the housing which receives the periphery of the diaphragm. In this arrangement, a gasket is interposed between the diaphragm and the flange and comprises a material which will prevent the ingress of water but will permit the passage of air.

The Neese U.S. Pat. No. 4,441,099 granted Apr. 3, 1984, discloses a vehicle horn in which the motor chamber is vented to the atmosphere through a passage formed in that portion of the plunger which confronts and extends through the diaphragm at the central opening therein.

A general object of this invention is to provide an improved venting arrangement for the motor chamber of a vehicle horn which will overcome certain disadvantages of the prior art.

SUMMARY OF THE INVENTION

In accordance with this invention, a vehicle horn is provided with improved venting means for the motor chamber which is reliable in operation and economical to manufacture. The improved venting arrangement provides a controlled degree of venting to prevent heat build-up and unwanted pressure distortion of the diaphragm without significant impairment of sound generation. This is accomplished by a vent hole in the diaphragm itself. It is disposed between the mounting regions of the diaphragm in an uncovered portion of the diaphragm. Preferably, the location of the vent hole is in a portion of the diaphragm which is subjected to relatively large vibratory motion. Further, according to the invention, the vent hole is of a diameter in the range of about 0.016 to 0.024 inches and is formed by laser drilling.

A more complete understanding of this invention may be obtained from the detailed description that follows taken with the accompanying drawings.

BEST MODE FOR CARRYING OUT THE INVENTION

Figure 1:
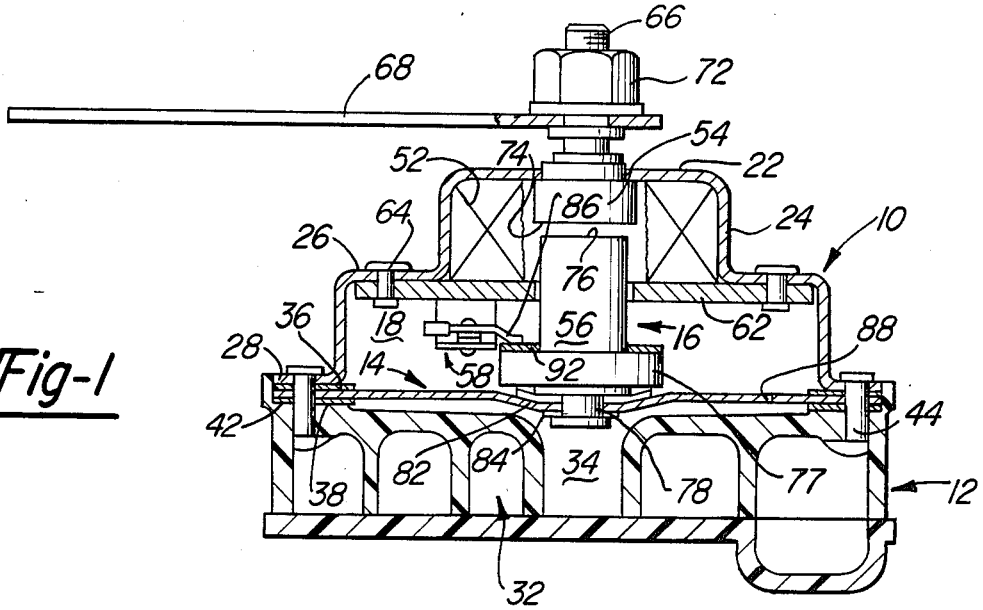
FIG. 1 is a cross-sectional view of a vehicle horn provided with the venting arrangement of this invention.
Figure 2:
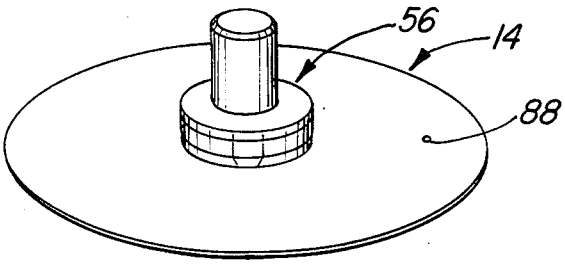
FIG. 2 is a perspective view of the horn diaphragm and plunger.

Referring now to the drawings, there is shown an illustrative embodiment of the invention in an automotive vehicle horn of the acoustical type. It will be appreciated as the description proceeds, that the invention is also useful in horns of other types.

Referring now to FIG. 1, there is shown a vehicle horn of the acoustical type with the improved venting means of this invention. The horn comprises, in general, a housing 10 upon which a sound projector 12 is mounted with a diaphragm 14 therebetween. The diaphragm is driven by a linear electromagnetic motor 16 disposed within the housing. The housing 10 and The diaphragm 14 define a motor chamber 18. Prior to describing the venting arrangement of this invention, the horn will be described in greater detail.

The housing 10 is generally cup-shaped and is formed of sheet metal. It is of circular cross-section and has a flat rear wall 22 and a stepped side wall 24 having an intermediate radially extending shoulder 26 and terminating in an annular mounting flange 28. The sound projector 12 is of the convoluted type and comprises a body of molded plastic with an internal spiral passage 32. The body of the projector 12 defined a plenum chamber 34 at the inlet of the passage and the passage extends in a divergent manner through the body and terminates at its outlet to the atmosphere in a bell, in the manner of a trumpet. The diaphragm 14 is constructed of a thin sheet of steel metal and is circular in shape. A pair of annular sealing gaskets 36 and 38 are disposed on opposite faces of the diaphragm 14 at the periphery thereof. The gasket 38 is seated on an annular mounting shoulder 42 on the projector 12. The mounting flange 28 of the housing 10 is disposed against the gasket 36 and set of rivets 44 extend therethrough to secure the assembly together. Thus, an air tight seal is provided around the periphery of the diaphragm. An annular mounting region on the rear face of the diaphragm 14 is defined by the overlying gasket 36. Similarly, an annular mounting region is defined on the front face of the diaphragm 14 by the overlying gasket 38. The diaphragm 14 will be described in further detail subsequently.

The linear electromagnetic motor 16 comprises, in general, an energizing coil 52, a pole piece 54, an armature or plunger 56 and a switch 58. The coil 52 is mounted within the housing 10 against the rear wall 22 and is held in place by a yoke 62 which is secured by rivets 64 to the shoulder 26 of the housing. The pole piece 54 is staked to the housing 10 in a circular opening in the rear wall 22. The pole piece is provided with a threaded stud 66 outside the housing which is adapted to receive a mounting bracket 68 secured to the stud by a nut 72. The inner end of the pole piece 54 terminates in a flat pole face 74 at an air gap between it and the end of the plunger 56. The plunger 56 is of stepped cylindrical configuration and is constructed of ferromagnetic material. The plunger 56 terminates at it rear end in a pole face 76 which confronts the pole face 74 within the coil 52. The plunger is provided with an annular shoulder 77 of enlarged diameter and a mounting stem 78 of reduced diameter. The stem 78 extends through a central opening in a saucer-shaped central portion of the diaphragm 14. A shaped washer 82 is disposed between the body of the plunger 56 and the diaphragm 14. A flat washer 84 is disposed between the diaphragm 14 and the end of the stem 78 which is upset to form a head which secures the plunger to the diaphragm. A central mounting region is defined on the rear face of the diaphragm 14 by the overlying washer 82 and on the front face of the diaphragm by the overlying washer 84. A free or uncovered surface of the diaphragm extends between the outer periphery of washer 82 and the inner periphery of gaskets 36 and 38. This arrangement provides an air tight seal between the plunger 56 and the diaphragm 14. The switch 58 comprises a pair of contacts which are adapted to connect the coil 52 with the battery of the vehicle through a horn switch (not shown). The switch 58 includes an actuating member which overlies an insulating washer 92 on the shoulder 77 and is actuated by movement of the plunger to open and close the switch contacts to control energization of the coil. When the coil is energized, the plunger 56 is caused to reciprocate and thus vibrate the diaphragm 14 to generate sound energy which is transmitted through the projector 12.

In order to prevent undue heating in the motor chamber 18 with consequent damage to the motor 16, means are provided to vent the chamber 18. The venting means comprises a small hole 88 through the free portion of the diaphragm. The hole 88 provides communication between the chamber 18 and the atmosphere through the projector 12. The hole 88 is located intermediate the inner periphery of the gaskets 36 and 38 and the outer periphery of the shaped washer 82 and somewhat closer to the former than the latter. Is has been found that a hole size of about one millimeter in diameter provides the desired degree of venting without significant loss in the generation of sound energy. In particular, a hole size in the range of 0.016 to 0.024 inches in diameter is preferable. In the illustrative embodiment, the diaphragm is of a thickness of about 0.015 inches and has an unclamped diameter, i.e. the inner periphery of the gaskets 36 and 38, of about 2 and three-quarters inches. The motor chamber has an air volume of about two and one-half cubic inches.

Figure 3:
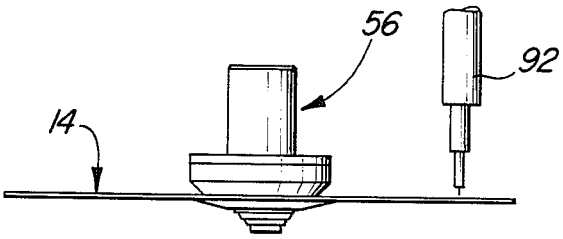
FIG. 3 shows the laser drilling of the horn diaphragm.

The hole 88 is formed in the diaphragm 14 by laser drilling as depicted in FIG. 3. For this purpose, the diaphragm 14 is retained in a suitable fixture (not shown) which positions the diaphragm relative to the head of a power laser 92. The laser beam is suitably focused and of sufficient power to drill the desired hole size with a momentary burst of energy. The laser drilling produces a fused edge of metal around the hole without irregularity or torn edges and the hole size is accurately controlled to the desired dimension. The smooth edge of the hole is believed to be the result of the combination of melting of the metal and condensation of the vapor phase of the metal produced by the laser beam. This smooth hole edge is especially advantageous in that there are no minute tears or irregularities around the hole which would give rise to stress concentration in the vibratory motion of the diaphragm which would lead to early failure.

As discussed above, the hole 88 is located in the radial direction about midway of the free surface of the diaphragm. It is preferably located on an undeformed portion of the diaphragm, i.e. remote from bends or corners which would give rise to stress concentration. Location of the hole about one-third of the radial distance from the inner periphery of gasket 36 to the outer periphery of washer 82 is preferred. This location is effective to keep the hole from clogging by moisture or other contaminants by reason of the motion and flexing of the diaphragm in that region and the isolation from outside air by the projector 12. Thus, effective venting is achieved without significant impairment of the sound generation or the structural integrity of the diaphragm.

Although the description of this invention has been given with reference to a particular embodiment, it is not to be construed in the limiting sense. Many variations and modifications will now occur to those skilled in the art. For a definition of the invention reference is made to the appended claims.

What is claimed is:

1. An electric vehicle horn of the type comprising a housing, a sound projector having an inlet and an outlet, a diaphragm disposed between said housing and said projector with its periphery clamped between the housing and the inlet of said projector said diaphragm and said housing forming a closed motor chamber, said projector having an air passage communicating between said diaphragm and the atmosphere at the outlet of said projector, electric motor means within said chamber coupled with said diaphragm and adapted to vibrate said diaphragm for generating sound energy, and vent means adapted to vent said chamber to the atmosphere to permit air flow into and out of said chamber the improvement wherein:

said electric motor means includes a vibratory plunger mounted in sealing relationship to the central portion of said diaphragm, said periphery of said diaphragm is mounted in sealing relationship to said housing, and said diaphragm includes a vent hole therethrough at a location intermediate said central portion and said periphery, said location being at a free surface of said diaphragm which is subject to vibratory motion by said motor, whereby vibration of said diaphragm by said motor causes air flow into and out of said chamber through said vent hole thereby keeping the vent hole free from clogging by moisture or particulate matter.

2. The invention as defined in claim 1 wherein said hole is round and the diameter is in the range of about 0.016 inches to about 0.024 inches.

3. The invention as defined in claim 2 wherein said hole is formed by laser drilling.

* * * * *